US007424919B2

(12) United States Patent
Friberg

(10) Patent No.: US 7,424,919 B2
(45) Date of Patent: Sep. 16, 2008

(54) METHOD FOR DETERMINING THE ANGULAR MOVEMENT OF THE OUTPUT SHAFT OF AN IMPULSE NUT RUNNER AT TIGHTENING A SCREW JOINT

(75) Inventor: John Robert Christian Friberg, Nacka (SE)

(73) Assignee: Atlas Copco Tools AB, Nacka (SE)

( * ) Notice: Subject to any disclaimer, the term of this patent is extended or adjusted under 35 U.S.C. 154(b) by 166 days.

(21) Appl. No.: 10/594,911

(22) PCT Filed: Mar. 31, 2005

(86) PCT No.: PCT/SE2005/000470

§ 371 (c)(1),
(2), (4) Date: Sep. 29, 2006

(87) PCT Pub. No.: WO2005/095061

PCT Pub. Date: Oct. 13, 2005

(65) Prior Publication Data

US 2008/0135269 A1 Jun. 12, 2008

(30) Foreign Application Priority Data

Apr. 1, 2004 (SE) ..... 0400867

(51) Int. Cl.
*B25B 23/14* (2006.01)

(52) U.S. Cl. ..... 173/1; 173/176; 173/183; 173/93.5

(58) Field of Classification Search ..... 173/1, 173/2, 176, 181, 182, 183, 93, 93.5, 93.6
See application file for complete search history.

(56) References Cited

U.S. PATENT DOCUMENTS

| | | | | |
|---|---|---|---|---|
| 5,092,410 | A | 3/1992 | Wallace et al. | |
| 5,366,026 | A * | 11/1994 | Maruyama et al. | 173/180 |
| 5,493,913 | A * | 2/1996 | Layer et al. | 73/761 |
| 5,519,604 | A * | 5/1996 | Hansson | 700/28 |
| 6,134,973 | A * | 10/2000 | Schoeps | 73/862.23 |
| 6,341,533 | B1 | 1/2002 | Schoeps et al. | |
| 6,765,357 | B2 * | 7/2004 | Cripe et al. | 318/114 |
| 6,923,268 | B2 * | 8/2005 | Totsu | 173/2 |
| 7,007,762 | B2 * | 3/2006 | Yamamoto | 173/1 |
| 7,089,080 | B1 * | 8/2006 | Lysaght | 700/160 |
| 2002/0189829 | A1 | 12/2002 | Cripe et al. | |

FOREIGN PATENT DOCUMENTS

WO WO 02/083366 A1 10/2002

* cited by examiner

*Primary Examiner*—Scott A. Smith
(74) *Attorney, Agent, or Firm*—Frishauf, Holtz, Goodman & Chick, P.C.

(57) ABSTRACT

A method for determining the angular displacement of the output shaft ($\phi_0$) of an impulse nut runner at tightening a screw joint to a predetermined final torque level ($T_f$) by an impulse nut runner having a motor driven impulse unit (23) with an inertia drive member (27), an output shaft (24) to be coupled to the screw joint to be tightened and an angle sensing device (35, 38) associated with the drive member (27) and arranged to deliver signals in response to the rotational movement of the drive member (27), wherein the total angular displacement of the output shaft (24) in relation to a threshold torque level ($T_t$) is calculated as a difference between the total angular displacement ($\phi_{Dtot}$) of the drive member (27) as a result of a total number of delivered impulses ($N_{tot}$) and the angle of the total number of full revolutions minus one full revolution $\lfloor (N_{tot}-1)\cdot 360)$.

2 Claims, 2 Drawing Sheets

METHOD FOR DETERMINING THE ANGULAR MOVEMENT OF THE OUTPUT SHAFT OF AN IMPULSE NUT RUNNER AT TIGHTENING A SCREW JOINT

This application is a U.S. National Phase Application under 35 USC 371 of International Application PCT/SE2005/000470 filed Mar. 31, 2005.

The invention relates to a method for determining the angular displacement of the output shaft of an impulse nut runner and, hence, the screw joint during a tightening process by using information from an angle sensing device which is arranged to detect the angular movement of the inertia drive member of the impulse nut runner.

In impulse nut runners there is a problem to obtain an accurate information about the angular displacement of the output shaft and, hence, the angular displacement of the screw joint during a tightening process. In prior art, there are described impulse nut runners where the output shaft is provided with an angle sensor for obtaining rotation angle related signals. See for instance U.S. Pat. No. 6,341,533. A problem concerned with this type of angle sensing device is that it causes an undesirable increase of the outer dimensions of the nut runner, the length of the tool in particular. Particularly, in such impulse nut runners where an angle sensor is already comprised for detecting angular displacement of the inertia drive member for torque calculation purposes an extra angle sensor at the output shaft adds unnecessarily to the outer dimensions and the complexity of the nut runner. See for instance WO 02/083366.

The main object of the invention is to create an impulse nut runner in which the angular displacement of the output shaft during tightening is obtained without using an angle sensing means on the output shaft. Instead, the angular displacement of the output shaft and the screw joint is readily calculated from angle signals provided by an angle sensing device detecting the angular displacement of the inertia drive member of the impulse unit.

Further objects and advantages of the invention will appear from the following specification and claims.

A preferred embodiment of the invention is described below with reference to the accompanying drawing.

IN THE DRAWING

Figure 1:
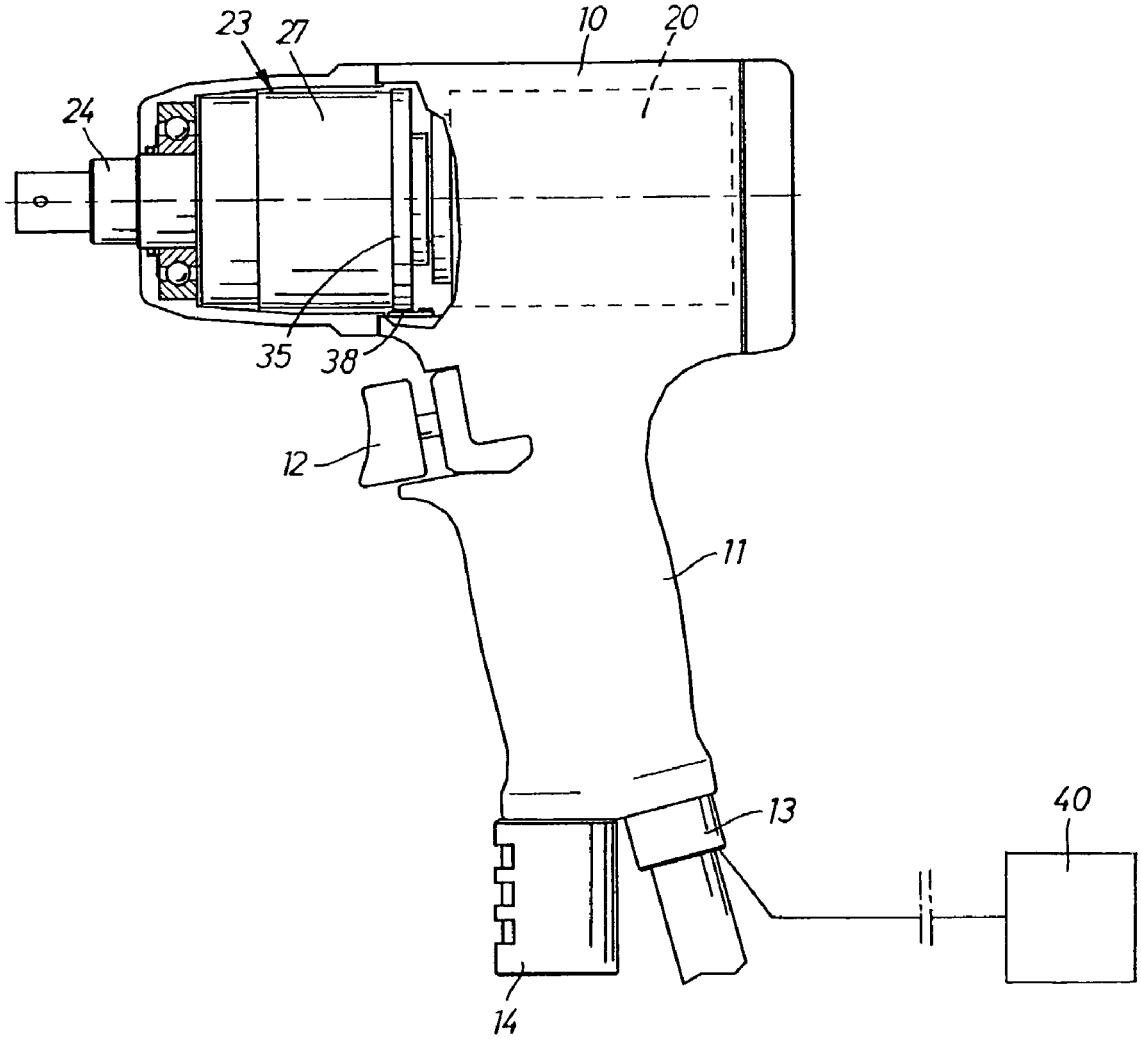
FIG. 1 shows, partly in section, a side view of a impulse nut runner suitable for performing the method according to the invention.
Figure 3A:
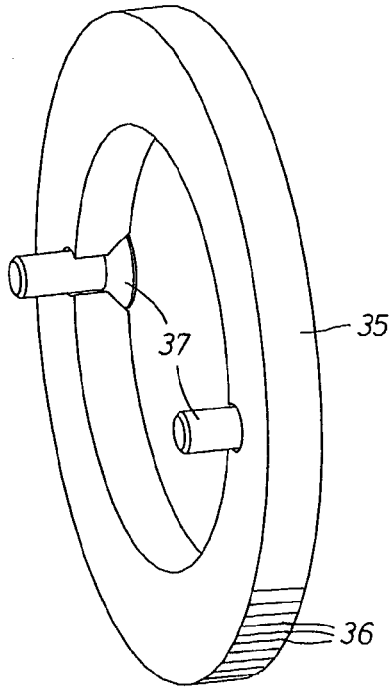

FIG. 3*a* shows a perspective view of a ring element forming part of the rotation detecting device of the tool in FIG. 1.

Figure 3B:
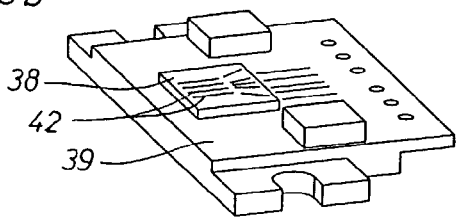

FIG. 3*b* shows a perspective view of a sensor unit forming part of the rotation detecting device.

The method according to the invention is intended to be performed by an impulse nut runner having a certain type of angle sensing means, namely an angle sensor associated with the inertia drive member of the torque impulse generating pulse unit. In order to improve understanding of the invention an impulse nut runner of this type is below described in detail.

The impulse nut runner schematically illustrated in FIG. 1 comprises a housing 10 with a handle 11, a throttle valve 12, a pressure air inlet connection 13 and an exhaust air outlet 14. The nut runner further comprises a pneumatic vane motor 20 with a rotor 21 and a stationary cylinder 22, a pulse unit 23 with an output shaft 24 for connection to a threaded fastener 25 via a nut socket 26.

The pulse unit 23 also comprises a cylindrical inertia drive member 27 which is rigidly connected to the motor rotor 21 and which contains a hydraulic fluid chamber 29 partly defined by a front end wall 30. The output shaft 24 is formed with a rear end portion 34 which extends into the hydraulic fluid chamber 29 to receive torque impulses from an impulse generating mechanism. The latter comprises two opposed pistons 31*a*, 31*b* which are reciprocated by two activation balls 32*a*, 32*b* in a transverse bore 33 in the output shaft 24. The balls 32*a*, 32*b* engage a non-illustrated cam surface on the inner cylindrical surface of the drive member 27. The pistons 31*a*, 31*b* form between them in the bore 33 a high pressure compartment for generating torque impulses.

This type of pulse unit is previously described in for instance U.S. Pat. No. 5,092,410 and is not described in further detail since it does not form a part of the invention.

Figure 2:
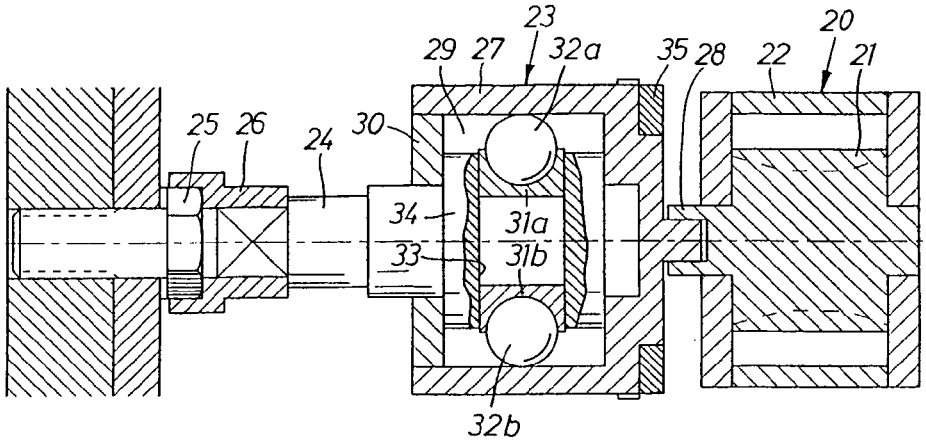
FIG. 2 illustrates schematically a longitudinal section through an impulse nut runner of the type shown in FIG. 1 in connection with a threaded fastener.

In order to detect the rotational movement of the rotating parts of the torque delivering tool the inertia drive member 27 is provided with a ring element 35 of a resinous material which is magnetised in a large number of parallel bands 36 representing magnetic poles equidistantly distributed throughout the circumference of the ring element 35. Se FIG. 3*a*. As illustrated in FIG. 2, the ring element 35 is secured to the inertia drive member 27 by two screws 37 and forms a rigid unit with the inertia drive member 27.

The angle encoder further comprises a stationary sensor unit 38 located on a circuit board 39 and arranged to detect the rotation of the inertia drive member 27 as a movement of the magnetic bands 36 of the ring element 35 past the sensor unit 38. The circuit board 39 is secured to the tool housing 10 which also contains power supply means connected to the motor 20. The sensor unit 38 is arranged to deliver signals in response to the number of passing magnetised bands 36, and an external control unit 40 connected to the sensor unit 38. The control unit 40 includes calculating means for determining the retardation magnitude of the rotating parts as well as the delivered torque by using the signals received from the sensor unit 38 and from the total inertia moment value as a tool related constant. Some signal treating electronics may also be located at the nut runner itself.

The sensor unit 38 comprises a number of elongate sensing loops 42 arranged in parallel and spaced relative to each other at a distance different from the spacing of the magnetised bands 36 on the ring element 35 so as to obtain phase delayed signals from the sensor unit 38. By this phase delay it is possible to determine in which direction the inertia member 27 is rotating.

The angle encoder described above is particularly suitable for this application since it has a rugged design and provides a very good angle resolution. It is not new in itself but is commercially available as a Series EK 622 Encoder Kit from the U.S.-based company Admotec (Advanced Motion Technologies).

In operation, the output shaft 24 is connected to the threaded fastener 25 via the nut socket 26, and the motor 20 is supplied with motive pressure air so as to deliver a driving torque to the pulse unit 23. As long as the torque resistance from the fastener 25 is below a certain level, the pulse unit 23 will forward the continuous motor torque directly to the output shaft 24, without generating any impulses. When the fastener 25 is properly run down and the torque resistance increases above this certain level, the pulse unit 23 starts converting the continuous motor torque into torque impulses. This means that the inertia drive member 27 is repeatedly accelerated during a full revolution between two successive impulses to deliver kinetic energy to the output shaft 24 via the impulse mechanism 23. The torque delivered via this kinetic energy is several times higher than the continuous torque delivered by the motor 20 and will accomplish a step-by-step tightening of the fastener 25.

By detecting the movement of the rotating parts by means of the magnetised ring element 35 and the sensor unit 38, the rotation speed as well as the retardation magnitude of the rotating parts may be calculated, and by using the retardation magnitude thus calculated and the total inertia moment of the drive member 27 and co-rotating parts of the tool the torque transferred to the fastener 25 may be determined.

According to the invention it is also possible to determine the angular displacement of the output shaft and the threaded fastener by using the signals generated by the angle sensor 35,38. Since the rotational movement $\phi_D$ of the drive member 27 during each impulse generation comprises one full revolution, i.e. 360°, plus the resultant displacement of the output shaft $\Delta\phi_O$ the total output shaft displacement $\phi_{Otot}$ can be calculated by determining at first the total rotation angle $\phi_{Dtot}$ of the drive member 27 and then reducing that angle by the total angle $\phi_{Ntot}$ of the total number of full revolutions: $N_{tot}\cdot 360°$, minus one full revolution: 360°. This could be expressed:

$$\phi_{Otot}=\phi_{Dtot}-(N_{tot}-1)\cdot 360$$

One full revolution has to be deducted since the first impulse could be preceded by an unknown acceleration angle of the drive member.

The total number of impulses as well as the total angular displacement $\phi_{Dtot}$ of the drive member 27 can not be counted from the very first impulse in the tightening process, because the initial part of the tightening is very uncertain due to setting of the screw joint etc. Instead, the total drive member displacement $\phi_{Dtot}$ is counted from a predetermined threshold torque level $T_t$ which suitably is a certain percentage of the desired final torque level $T_f$, for instance 50%.

The method according to the invention is advantageous in that the angular displacement of the output shaft may be safely determined by means of signals delivered by a angle sensor associated with the impulse unit drive member which is also used for other purposes like calculation of the delivered output torque of the nut runner and does not require any extra angle sensing means that would add to the outer dimensions and complexity of the nut runner.

The invention claimed is:

1. A method for determining an angular displacement of an output shaft of an impulse nut runner at tightening of a screw joint to a desired final torque level, wherein the impulse nut runner includes an impulse unit with a motor driven inertia drive member delivering one torque impulse per full revolution relative to the output shaft, and an angle sensing device arranged to detect a rotational movement of the inertia drive member, said method comprising:

defining a threshold torque level from which the rotational movement of the inertia drive member is to be detected, determining a total rotation angle of the inertia drive member accomplished by a total number of torque impulses counted from said threshold torque level, and calculating a total angular movement of the output shaft accomplished by the total number of torque impulses counted from said threshold torque level by reducing said determined total rotation angle of the inertia drive member counted from said threshold torque level by the total angular movement of said total number of full revolutions minus one full revolution.

2. The method according to claim 1, wherein said threshold torque level is a predetermined percentage of the desired final torque level.

* * * * *